US005662467A

United States Patent [19]

Jones

[11] Patent Number: 5,662,467

[45] Date of Patent: Sep. 2, 1997

[54] NOZZLE MIXING LINE BURNER

[75] Inventor: Andrew P. Jones, Muncie, Ind.

[73] Assignee: Maxon Corporation, Muncie, Ind.

[21] Appl. No.: 539,712

[22] Filed: Oct. 5, 1995

[51] Int. Cl.[6] ..... F23C 5/28

[52] U.S. Cl. ..... 431/175; 431/354; 239/419; 239/557; 239/566

[58] Field of Search ..... 431/8, 175, 176, 431/351, 353, 354; 126/91 A; 239/566, 556, 557, 419

[56] References Cited

U.S. PATENT DOCUMENTS

| | | | |
|---|---|---|---|
| Re. 25,626 | 7/1964 | Yeo et al. | 263/19 |
| 1,771,875 | 7/1930 | Cowardin et al. . | |
| 1,960,609 | 5/1934 | Werner | 431/175 |
| 1,990,962 | 2/1935 | Thorson | 431/175 |
| 2,276,131 | 3/1942 | Wiant | 299/59 |
| 2,824,603 | 2/1958 | Reed | 431/176 |
| 3,174,527 | 3/1965 | Reed et al. | 431/175 |
| 3,178,161 | 4/1965 | Yeo et al. | 263/19 |
| 3,237,677 | 3/1966 | Wiesenthal et al. | 431/175 |
| 3,297,259 | 1/1967 | Maxon et al. | 239/397.5 |
| 3,511,589 | 5/1970 | Rothhaar et al. . | |
| 4,155,700 | 5/1979 | Babington | 431/351 |
| 4,340,180 | 7/1982 | Belknap et al. | 239/422 |
| 4,379,689 | 4/1983 | Morck, Jr. | 431/284 |
| 4,403,947 | 9/1983 | Spielman | 431/353 |
| 4,483,832 | 11/1984 | Schirmer | 423/210 |
| 4,598,553 | 7/1986 | Saito et al. | 60/733 |
| 4,963,089 | 10/1990 | Spielman | 431/351 |
| 5,057,008 | 10/1991 | Dielissen | 431/351 |
| 5,131,836 | 7/1992 | Coppin | 431/12 |
| 5,236,350 | 8/1993 | Cummings, III et al. | 431/173 |

*Primary Examiner*—Carroll B. Dority
*Attorney, Agent, or Firm*—Barnes & Thornburg

[57] ABSTRACT

A nozzle mixing line burner includes a line-burner combustion chamber and a nozzle body coupled to the chamber. The nozzle body includes a first channel having a first inlet receiving air, a second inlet receiving fuel, an air and fuel mixing chamber communicating with the first and second inlets and for discharging an air and fuel mixture created within the air and fuel mixing chamber along a first flow path out from the nozzle body. The nozzle body further includes a first opening receiving air, a second opening receiving fuel, and an air and fuel combining chamber communicating with the first and second openings and an exit for discharging a second air and fuel mixture created in the air and fuel combining chamber along a second flow path out from the nozzle body. The second flow path intersects the first flow path at an impingement point in the combustion chamber to cause impingement of the mixtures carried along the first and second flow paths to create flame stability.

49 Claims, 3 Drawing Sheets

NOZZLE MIXING LINE BURNER

BACKGROUND AND SUMMARY OF THE INVENTION

The present invention relates to a line burner, and particularly, to a nozzle mixing line burner. Most particularly, the invention relates to a low emission, air/fuel mixing nozzle line burner that produces a short flame.

Line burners are known. Manufacturers and users of line burners generally desire a burner that is efficient and thus conserves energy. Efficiency is often measured by the burner's turn-down ratio. The turn-down ratio of a burner refers to a ratio of a maximum "firing rate" to a minimum firing rate for a particular burner assembly. The firing rate is the measure of how much fuel gas is consumed per hour (btu/hr). In industrial applications, a high turn down ratio is preferred because it reflects the burners ability to consume less fuel at the minimum firing rate (similar to a "low-idle" in an automobile). A typical premix-type line burner has a maximum turn-down ratio of 10:1 where ten times as much fuel is fed into the flame at the maximum firing rate than at the minimum firing rate.

Another desirable feature of a line burner is a minimal amount of hardware necessary to construct the burner. The reduction in hardware allows the manufacturer to manufacture the burners at a lower cost, the savings of which may be passed on to consumers.

One example of a known line burner is U.S. Pat. No. 5,057,008 to Dielissen which describes a raw gas burner nozzle with mixing plates through which combustion air flows to create the turbulence required for combustion. Another type of burner that pre-mixes the fuel and the air is shown in U.S. Pat. No. 5,236,350 to Cummings, III et al. For an additional example of a known burner, see U.S. Pat. No. 5,131,836 to Coppin. What is needed is a nozzle mixing line burner that creates locally lean combustion through most of its operating range and has a turn-down ratio well above that standard in the industry, without additional hardware.

One object of the present invention is to provide a nozzle mixing line burner having a nozzle body with fuel/air mixing channels angled relative to one another in a manner to cause impingement of air/fuel mixtures streaming into a combustion chamber to create a flame quality and emissions substantially equivalent to expensive ultra-lean combustors.

Another object of the present invention is to provide a nozzle assembly for use in a line burner that allows the line burner to have a turn-down ratio of more than 10:1 and preferably at least 20:1.

A burner apparatus in accordance with the present invention includes a line-burner combustion chamber and nozzle body coupled to the combustion chamber. The nozzle body is also formed for attachment with an air housing. The nozzle body includes two channels extending therethrough that are formed to pre-mix the air and fuel. Each of the channels include an inlet or opening for receiving air from an air supply plenum within the air housing and an outlet or exit for discharging a fuel/air mixture created within the channels into the line-burner combustion chamber.

In order to feed fuel into the channels, the nozzle body is formed to include a fuel-distribution chamber positioned between the channels. The fuel-distribution chamber is fed by a fuel supply line extending through the plenum of the air housing. In addition, at least one fuel passageway is formed between the fuel-distribution chamber and each of the channels so that fuel within the fuel-distribution chamber flows into the channels.

In preferred embodiments of the present invention, the nozzle body is formed to include a raw gas hole or delivery passageway extending between the fuel-distribution chamber and the line-burner combustion chamber. The raw gas hole is preferably positioned equidistant between the respective outlet and exit of the channels. Thus, the raw gas hole permits additional fuel to be fed to the line-burner combustion chamber to increase flame stability.

The nozzle body may be formed to include a plurality of channels positioned in a linear spaced-apart relation to one another along the line-burner combustion chamber to form one row of channel outlets and an opposite row of channel exits in said chamber. In addition, cooling air holes or delivery passageways extend between the air plenum and the combustion chamber. The cooling air holes are positioned in spaced-apart relation to one another between the outlets in one row and the exits in the second row. The cooling air holes allow the burner manufacturer to construct the combustion chamber from a lower grade of material.

In another embodiment of the present invention, the burner apparatus includes a line-burner combustion chamber and nozzle body coupled to the combustion chamber. The nozzle body includes two opposed slots that are formed to pre-mix the air and fuel therein and which extend along the length of the line-burner combustion chamber. The slots are formed similarly to the above-described channels, except that each slot itself forms a row extending across the line-burner combustion chamber. Illustratively, the two opposed slots are arranged to lie in spaced-apart parallel relation.

The burner assembly of the present invention creates a lean fuel/air mixture within the nozzle assembly and impinges jets of the mixture into each other to create flame stability, enhanced mixing, CO burnout, and $NO_x$ reburn. The burner assembly has the advantage of utilizing a common fuel-distribution chamber for both the fuel passages and raw gas channels without additional or separate piping or connections.

Advantageously, the turn-down ratio of the new burner is higher than any known premix line burner. The nozzle mixing line burner of the present invention can be operated at a turn-down ratio of at least 10:1 and as high as 40:1. Expensive premix equipment and flame arresters are not required by the new burner assembly of the present invention. In fact, flame propagation purposefully occurs back to the point of fuel injection in the burner of the present invention.

Additional objects, features, and advantages will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

A nozzle mixing line burner apparatus in accordance with the present invention creates locally lean combustion through most of its operating range by mixing the fuel and air prior to combustion at a turn-down ratio of at least 10:1 and as high as about 40:1. Throughout the specification and claims herein, turn-down ratio refers to the ratio of the maximum and minimum firing rate for a particular burner assembly and firing rate is the measure of how much fuel gas is consumed per hour (btu/hr). For example, at a turn-down ratio of 20:1, twenty (20) times as much fuel gas is fed into the flame at the maximum firing rate than at the minimum firing rate. A high turn-down ratio is particularly beneficial because of the fuel savings that may be obtained when the burner is operated at the minimum firing rate.

Figure 1:
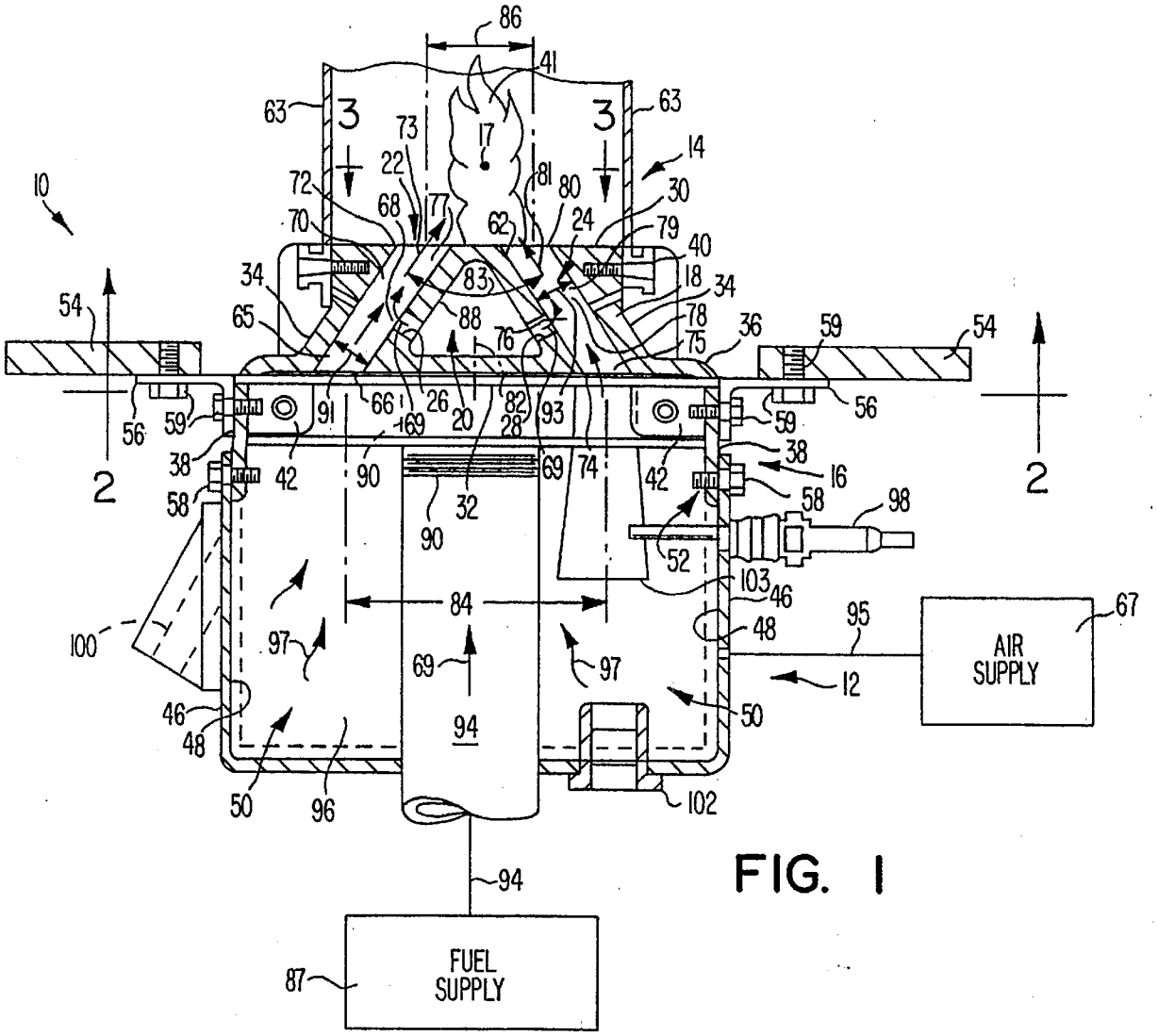
FIG. 1 is a cross-sectional view of a nozzle mixing line burner in accordance with the present invention showing a combustion chamber, an air housing, a nozzle body coupled between the combustion chamber and the air housing and having fuel passages opening into fuel/air mixing channels, wherein the fuel/air mixing channels are angled relative to one another to cause impingement of air and fuel mixtures flowing from the channels formed in the nozzle body into the combustion chamber.
Figure 2:
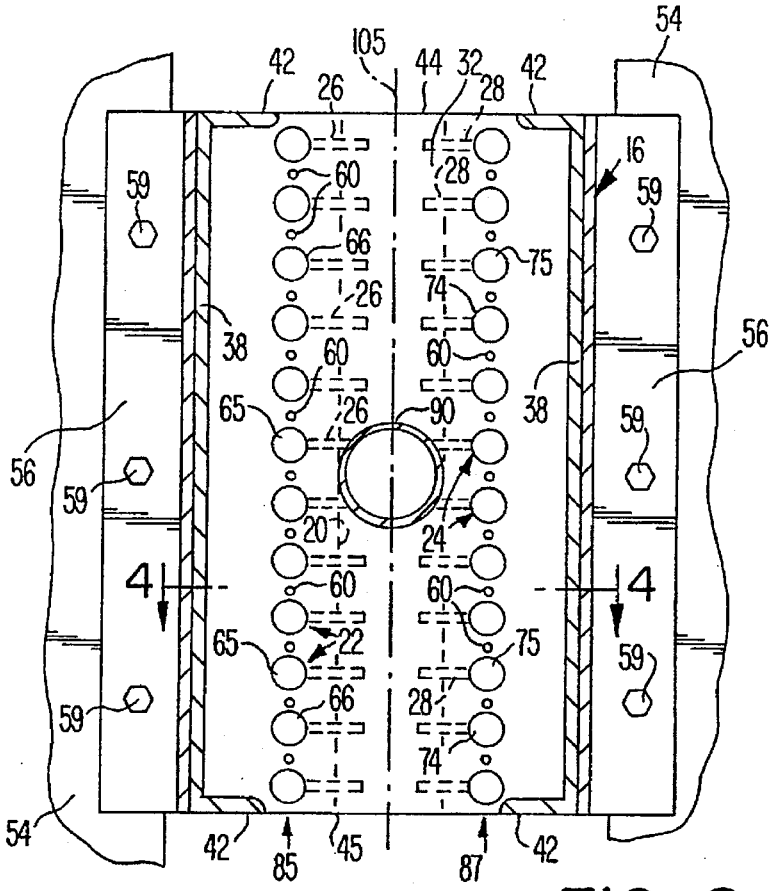
FIG. 2 is a view of the nozzle body taken along lines 2—2 of FIG. 1 showing an oven wall, a mounting plate, a back face of the nozzle body, two rows of fuel/air mixing channel inlets formed in the back face of the nozzle body, a fuel-distribution system (shown in phantom) for discharging fuel into each of the fuel/air mixing channels formed in the nozzle body, and a plurality of cooling air mixing holes formed in the nozzle body and positioned to lie in spaced-apart relation to one another so that one cooling air mixing hole lies between each pair of adjacent fuel/air mixing channel inlets formed in the nozzle body.

As shown in FIG. 1, a nozzle-mixing line burner 10 is provided which includes an air housing 12, a combustion chamber or sleeve 14, and a nozzle assembly 16 positioned to lie between the air housing 12 and the combustion chamber 14. The nozzle assembly 16 premixes fuel 69 and air 97 prior to combustion and causes impingement of the fuel/air mixture at impingement point 17 in the combustion chamber 14 as shown in FIGS. 1 and 2.

Figure 3:
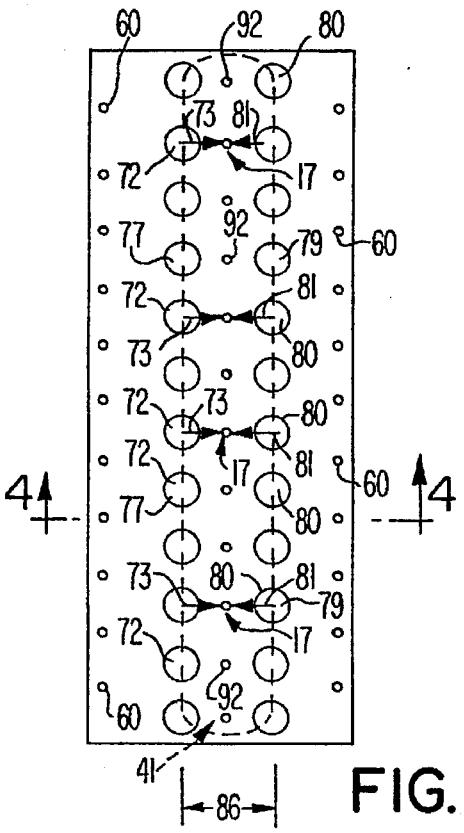
FIG. 3 is a plan view of the nozzle body taken along line 3—3 of FIG. 1 showing impingement of fuel/air flows discharged from a left-side row of discharge openings and a right-side row of discharge openings and showing two rows of cooling air holes along side edges of nozzle body and a single row of raw gas holes between the two rows of fuel/air mixing channel discharge openings.
Figure 3A:
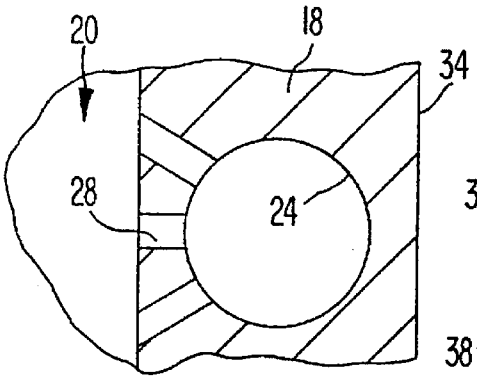
FIG. 3*a* is a view of an alternative embodiment of a fuel-distribution system in which the nozzle body is formed to include three separate fuel passageways for discharging fuel into each fuel/air mixing channel.

One embodiment of the nozzle assembly 16 is illustrated in FIG. 1. Nozzle assembly 16 includes a nozzle body 18 having a fuel-distribution chamber 20, two rows of opposing fuel/air mixing channels 22, 24, and a single fuel passage 26, 28 extending between the fuel-distribution chamber 20 and each of the opposing fuel/air mixing channel's 22, 24 respectively to allow fuel 69 to be dispersed from the fuel-distribution chamber 20 to the fuel/air mixing channels 22, 24 as shown in FIGS. 1–3. It is contemplated that multiple fuel passages 26, 28 may extend between the fuel-distribution chamber 20 and each fuel/air mixing channel 22, 24 as shown in FIG. 3*a*.

The fuel/air mixing channels 22, 24 serve as air passageways that conduct combustion air through the nozzle body 18 from the air housing 12 through the front face 30 of the nozzle body 18 and into the combustion chamber 14 at a predetermined velocity. Referring now to FIG. 1, a first air passageway 65 lies in a first plane and a second air passageway 75 lies in a second plane. The first and second air passageways 65, 75 are aligned at an acute dihedral angle 83 to define a fuel supply region 71 in the nozzle body 18. This fuel supply region 71 therefore lies between the first and second passageways 65, 75. As shown in FIG. 2, the first and second air passageways 65, 75 may be formed as rows 85, 87 of air passageways 65, 75 arranged to lie in a spaced-apart relation to one another. These rows 85, 87 of air passageways 65, 75 are arranged to lie in spaced-apart relation to one another inside the nozzle body 18.

The relative positioning of the fuel passages 26, 28 and the opposing fuel/air mixing channels 22, 24 allow the user of the burner apparatus 10 to manage "flashback". Flashback is a situation where the flame propagates back to the point of fuel injection into air or the oxygen source. Previous methods for managing flashback were to increase the velocity of the air and fuel streams to a high level or to discharge a pre-mix of fuel and air held within a mixing chamber of plenum across a flame holder or through a flame arrestor appliance. The nozzle mixing line burner apparatus 10 of the present invention manages flashback without additional hardware or maintaining increased velocities.

Continuing to refer to FIG. 1, the nozzle body 18 includes a front face 30 and an opposed back face 32 arranged to lie in spaced-apart relation to front face 30. Exterior side walls 34 extend between the front and back faces 30, 32 and are formed to include a shoulder 36 extending outwardly therefrom. In addition, mounting walls 38 extend from the shoulder 36 away from the front face 30 for attachment with the air housing 12. As shown in FIG. 1, the front face 30 of the nozzle body 18 is flat and extends between the side walls 34. The nozzle assembly 16 is illustratively attached to the combustion chamber 14 by a pair of screws 40 which extend through openings provided in the combustion chamber 14 and into the opposed exterior side walls 34 of the nozzle body 18. It is understood however, that tabs, rivets, rods, clips, or comparable attachment means may be used to attach the combustion chamber 14 to the nozzle assembly 16.

In preferred embodiments of the present invention, the nozzle body 18 includes flanges 42 formed on the shoulder 36 at opposite ends 44, 45. See, for example, FIG. 2. These flanges 42 interlock with similarly formed nozzle assemblies (not shown) so that multiple nozzle assemblies may be connected together along the air housing 12 to increase the length of a flame 41 produced in the combustion chamber 14 by the line burner apparatus 10. When, however, a plurality of nozzle assemblies 16 are mounted together, end caps (not shown) may be used adjacent the flanges 42 to plug the fuel-distribution chamber 20 and the air housing 12.

Referring again to FIG. 1, the air housing 12 includes an outer wall 46 and an opposite inner wall 48 and is configured to define a cavity 50 sized to receive the mounting walls 38 of the nozzle body 18. The nozzle assembly 16 is formed to be mounted securely on the air housing 12. Apertures 52 extend through the mounting walls 38 which are sized for extension of mounting screws 58 therethrough. Tabs, rivets, rods, clips, or comparable attachment means may also be used to attach the mounting walls 38 to the air housing 12.

In preferred embodiments, the nozzle assembly 16 is further formed for attachment with an oven wall 54 or support structure within a duct (not shown). As shown in FIG. 1, mounting brackets 56 are provided for extension between the mounting walls 38 of the nozzle body 18 and the oven wall 54 to provide either a sealed or unsealed attachment. Screws 59 extend through the mounting bracket 56 and the nozzle body 18 for secure attachment therebetween. It is understood that any of the above mentioned attachment means may be employed to secure the nozzle body 18 on the wall.

The nozzle body 18 is preferably cast from iron and formed as a unitary body. See for example, FIG. 1. The air housing 12 however, may be fabricated from aluminum or iron extrusions, castings, and/or sheet metal. The combustion chamber 14 can be fabricated from stainless steel sheet metal or castable alumina refractory. In the event that the combustion chamber 14 is fabricated from sheet metal, a plurality of cooling air holes or delivery passageways 60 are preferably formed through the front face 30 of the nozzle body 18. See, for example, FIGS. 2 and 3. The cooling air holes 60 are used to cool the combustion chamber 14 and thus enable the burner manufacturers to construct the combustion chamber 14 of lower grade steel.

Referring to FIGS. 1–3, the opposed fuel/air mixing channels 22, 24 are defined by channel walls 62 and are positioned to extend between the front and back faces 30, 32 of the nozzle body 18. The first fuel/air mixing channel 22 includes first inlet 66 at the back face 32 receiving air from an air supply 67, a second inlet 68 within the channel wall 62 receiving fuel 69, an air and fuel mixing chamber 70 communicating with the first and second inlets 66, 68, and an outlet 72 for discharging a fuel/air mixture created within the air and fuel mixing chamber 70 along a first flow path 73 out from the nozzle body 18 into the combustion chamber 14. The first fuel/air mixing channel 22 includes an air and fuel mixing and delivering channel section 77 receiving fuel 69 through the second inlet 68 and interconnecting the second inlet 68 and the outlet 72. As shown in FIG. 1, the air and fuel mixing and delivering channel section 77 associated with the first channel means 22 has a substantially uniform transverse cross-sectional dimension as shown by arrow 91 between the second inlet 68 and the outlet 72. The first fuel/air mixing channel 22 also includes the first air-conducting channel section 65 receiving air 97 through the first inlet 66 and communicating air 97 into the air and fuel mixing and delivering channel section 77 to mix with fuel 69 therein to create the first fuel/air mixture. The second fuel/air mixing channel 24 includes a first opening 74 through the back face 32 receiving air from the air housing 12, a second opening 76 through the channel wall 62 receiving fuel, an air and fuel combining chamber 78 communicating with the first and second openings 74, 76, and an exit 80 through the front face 30 for discharging a second fuel/air mixture created within the air and fuel combining chamber 78 of the nozzle body 18 into the combustion chamber 14 along a second flow path 81. The second fuel/air mixing channel 24 includes an air and fuel combining and delivering channel section 79 receiving fuel 69 through the second opening 76 and interconnecting the second opening 76 and the exit 80. FIG. 1 illustrates the air and fuel combining and delivering channel section 79 having a substantially uniform transverse cross-sectional dimension as shown by arrow 93 between the second opening 76 and the exit 80. The second fuel/air mixing channel 24 also includes the second air-conducting channel section 75 receiving air 97 through the first opening 74 and communicating air 97 into the air and fuel combining and delivering channel section 79 to mix with fuel 69 therein to create the second fuel/air mixture.

To create the desired flame stability, it is necessary to position the fuel/air mixing channels 22, 24 at an angle 83 sufficient to cause impingement of the fuel/air mixtures flowing along flow paths 73, 81 in the combustion chamber 14. Illustratively, inlet 66 and the first opening 74 are positioned at a first distance 84 from one another and outlet 72 and exit 80 are positioned a second distance 86 from one another. The first distance 84 is greater than the second distance 86. Moreover, a central axis 82 extends through the nozzle assembly 16 and the included angle of the opposed fuel/air mixing channels 22, 24 is preferably about sixty (60) degrees. It is contemplated, however that this angle could be varied without affecting performance of the burner so long as the first and second flow paths 73, 81 of the fuel/air mixtures impinge within the combustion chamber 14.

Referring to FIG. 2, a plurality of first and second channels 22, 24 are positioned in spaced-apart relation to one another between the opposite ends 44, 45 of the nozzle body 18. Illustratively, the first inlets 66 form a first row 85 through the back face 32 and the first openings 74 form a second row 87 through the back face 32. It is therefore understood that the outlets 72 and the exits 80 form respective rows (See FIG. 3) through the front face 30. Generally, the rows of channels 22, 24 are linear in shape and extend between the opposite ends 44, 45 of the nozzle body 18. The cooling air holes 60 are positioned in spaced-apart relation to one another through the nozzle body 18. One air hole 60 is preferably positioned between adjacent channels 22 in the first row 85 and one air hole 60 is positioned between adjacent channels 24 in the second row 87.

Figure 4:
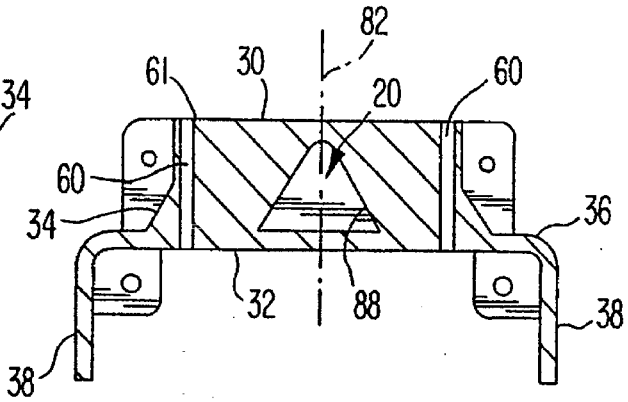
FIG. 4 is a view of the nozzle body taken along lines 4—4 of FIG. 2 showing the nozzle body having a front face and the cooling air mixing holes extending through the nozzle body between the front and back faces.

Referring now to FIG. 4, the cooling air holes 60 are formed to conduct air through nozzle body 18 between the front and back faces 30, 32 of the nozzle body 18. Preferably, the cooling air holes 60 extend through the nozzle body 18 so that outlets 61 of the holes are positioned adjacent the exterior side walls 34 of the nozzle body 18. Therefore, cooling air flowing through holes 60 will cool side walls 63 of the combustion chamber 14. See, for example, FIG. 1.

Referring now to FIG. 1, the fuel-distribution chamber 20 has a triangular cross-section and is positioned to lie within the nozzle body 18 between the opposed fuel/air mixing channels 22, 24 and along the central axis 82. It is understood that the cross-section of the fuel-distribution chamber 20 may be formed in a variety of shapes within the nozzle body 18. The fuel-distribution chamber 20 is defined by an inner wall 88. Moreover, the fuel passages 26, 28 extend through the inner wall 88 to place the fuel-distribution chamber 20 in fluid communication with the fuel/air mixing channels 22, 24. In addition, the fuel-distribution chamber 20 includes a fuel entrance 86 for receiving fuel 69 from a fuel supply 87. In preferred embodiments of the present invention, at least one raw gas channel or delivery passageway 92, is formed to extend between the inner wall 88 and the front face 30 to place the fuel-distribution chamber 20 in fluid communication with the combustion chamber 14.

As shown in FIG. 1, the fuel passages 26, 28 are formed in the nozzle body 18 by drilling the passages 26, 28 throughout the exterior side walls 34, the channels 22, 24, and into fuel-distribution chamber 20. Therefore, to prevent air 97 from escaping from the nozzle body 18 during operation of the burner apparatus 10, the side walls 63 of the combustion chamber 14 may be affixed to the nozzle body 18 as shown in FIG. 1 so as to seal the exterior walls 34.

However, end plugs (not shown) could also be inserted into the passageway or adhesives (not shown) could be used to seal the exterior walls 34.

The air housing 12 itself includes a fuel supply line 94 which is formed to feed fuel 69 through the fuel entrance 90 of the nozzle assembly 16 and subsequently into the fuel-distribution chamber 20. In addition, the air housing 12 includes a blower or fan (not shown) connected to the air housing 12 to pull air from air supply 67 along air supply line 95 and form an air plenum 96 within the cavity 50. Air within the plenum 96 is composed of oxygen and inerts and flows, as indicated by arrows 97, throughout the cavity 50 and into the inlet 66 and opening 74 of channels 22, 24. An ignitor 98 is further mounted in the air housing 12. In preferred embodiments, the air housing 12 may include a scanner 100 or other flame detecting device to detect the fuel/air mixture and a pilot gas inlet 102. Pilot fuel (not shown) is introduced into the air housing 12 at fuel gas inlet 102. The pilot fuel mixes with air from the air supply 67 and is directed into a pilot mixing tube 103. At this time, the ignitor 98 produces a spark that ignites a pilot flame (not shown). The pilot mixing tube 103 directs the pilot flame into the first opening 74. The pilot flame in turn ignites the flame 41 that is produced in the combustion chamber 18. Once flame 41 is ignited, the flow of the pilot fuel (not shown) is interrupted and the pilot flame is extinguished. The mounting bracket 56, ignitor 98, fuel supply line 94, and scanner 100 may fabricated or purchased from a number of sources or materials standard to the industry.

Figure 5:
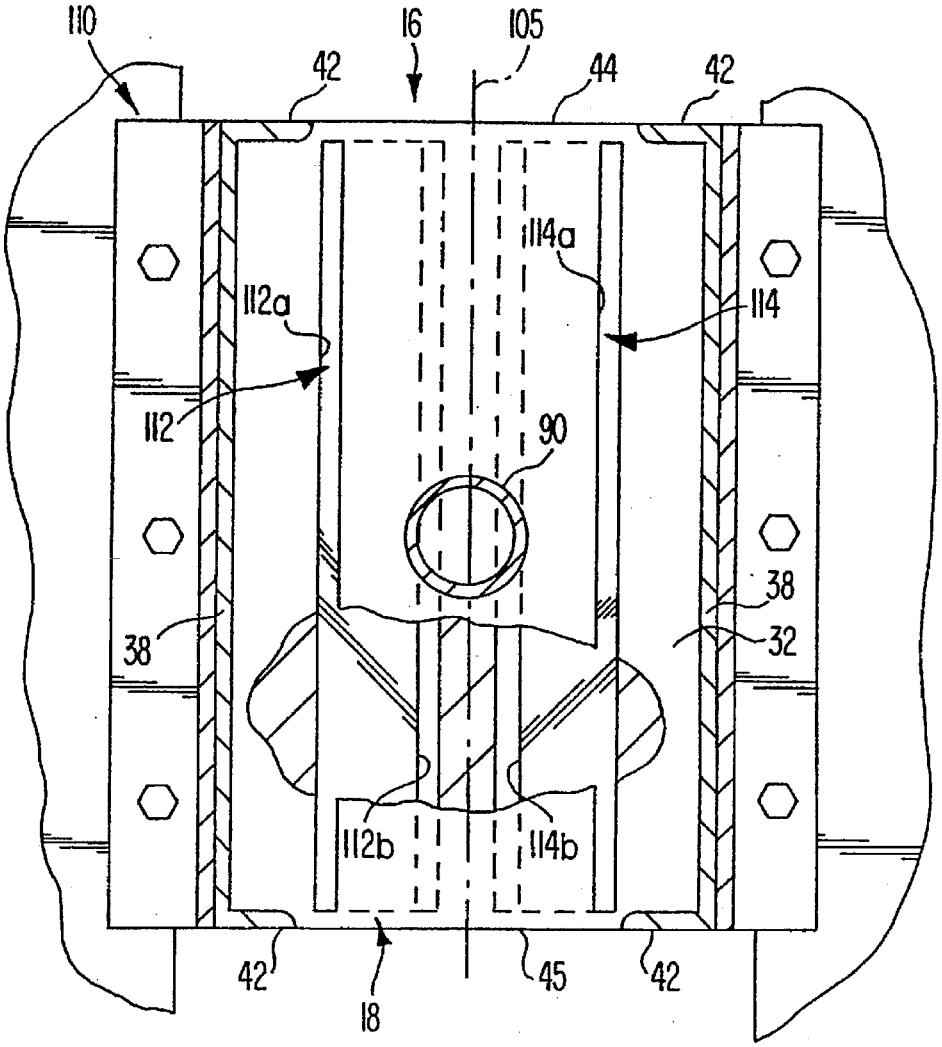
FIG. 5 is a view similar to FIG. 2 with a portion broken away of an alternative embodiment of the present invention showing the nozzle head having two spaced-apart parallel fuel/air mixing slots extending through the back face, two spaced-apart parallel fuel/air mixing slots extending through the front face and having inlets 112*a*, 114*a* and outlets 112*b*, 114*b*, and angled fuel/air mixing channels extending therebetween.

Furthermore, in an alternative embodiment of a nozzle-mixing line burner 110 in accordance with the present invention, a nozzle assembly 16 employs fuel/air mixing slots 112, 114 in place of the fuel/air mixing channels 22, 24. See, for example, FIG. 5. The fuel/air mixing slots 112, 114 are angled through the nozzle body 18 similarly to the fuel/air channels 22, 24 shown in FIG. 1. Both fuel and air is preferably delivered to the fuel/air mixing slot 112, 114 similarly to the nozzle assembly 16 of FIG. 1.

In practice of the method of the present invention, air 97 is fed to the cavity 50 of the air housing 12 from the air supply 67 through supply line 95. The air 97 circulates as shown by arrows 97 through the cavity 50 and enters nozzle body 18 through the first inlet 68 and the first opening 74 of the fuel/air mixing channels 22, 24. This air 97 in turn flows along flow paths 73, 81 into the air and fuel mixing chamber 70 and the air and fuel combining chamber 78 respectively. Fuel 69 is delivered from the fuel supply 87 to the fuel supply line 94. Fuel 69 then flows from the supply line 94 to the fuel-distribution chamber 20 via the fuel entrance 86. The fuel 69 then travels through the fuel passages 26, 28 and into the air and fuel mixing chamber 70 and the air and fuel combining chamber 78 of the opposed fuel/air mixing channels 22, 24. It is preferred that the fuel/air ratio within the air and fuel mixing chamber 70 and the air and fuel combining chamber 78 of channels 22, 24 be greater than 14:1. The fuel 69 that exits the fuel passages 26, 28 through the second inlet 68 and the second opening 76 combines with the air 97 flowing along flow paths 73, 81. Upon contact with the air 97, the fuel 69 is dispersed and pushed along the paths 73, 81 toward the front face 30 of the nozzle body 18. Thus, it can be said that the air 97 and fuel 69 are pre-mixed within channels 22, 24.

The pre-mix of air 97 and fuel 69 is pushed from the outlet 72 and exit 80 of channels 22, 24 and into the combustion chamber 14. The fuel/air mixture 73 from the channel 22 impinges with the fuel/air mixture 81 that exits through the front face 30 from the opposing fuel/air mixing channel 24 at impingement points 17 as shown, for example, in FIGS. 1 and 3. The impingement of mixtures 73, 81 furthers the mixing of the fuel and air constituents, provides for flame stability, and creates a sheet flame 41.

The multiple impingements occur within the combustion chamber 14 at a series of points 17 located just downstream of the front face 30 along a longitudinal centerline 105 (see FIG. 2) of the nozzle assembly 16 to provide a line of flame 41 shown in FIGS. 1 and 3. The longitudinal proximity of pairs of fuel/air mixing channels 22, 24 provide for flame 41 continuity. Preferably, the raw gas injected by the raw gas channel 92 merges with the coalescing sheet flame 41. The raw gas injected axially accounts for 0–30% or more of the total head release of the burner 10.

Although the invention has been described in detail with reference to certain preferred embodiments, variations and modifications exist within the scope and spirit of the invention as described and defined in the following claims.

What is claimed is:

1. A burner apparatus comprising a combustion chamber having opposite side walls and a one-piece nozzle body made of a metal material and including a front face coupled to the combustion chamber and positioned to lie substantially perpendicular to the opposite side walls, and a back face facing away from the combustion chamber, the one-piece nozzle body being formed to include a first channel having a first inlet receiving air and being formed in the back face, a second inlet receiving fuel, an air and fuel mixing chamber communicating with the first and second inlets, and an outlet formed in the front face for discharging a fuel/air mixture created within the air and fuel mixing chamber along a first flow being formed from the one-piece nozzle body into the combustion chamber, and the one-piece nozzle body also being formed to include a second channel having a first opening receiving air and being formed in the back face, a second opening receiving fuel, an air and fuel combining chamber communicating with the first and second openings, and an exit formed in the front face for discharging a second fuel/air mixture created in the air and fuel combining chamber along a second flow path out from the one-piece nozzle body into the combustion chamber, and wherein the second flow path intersects the first flow path in the combustion chamber to cause impingement of the mixtures carried along the first and second flow paths to create flame stability.

2. A burner apparatus comprising a combustion chamber, and a nozzle body coupled to the combustion chamber, the nozzle body being formed to include a first channel having a first inlet receiving air, a second inlet receiving fuel, an air and fuel mixing chamber communicating with the first and second inlets, and an outlet for discharging a fuel/air mixture created within the air and fuel mixing chamber along a first flow path out from the nozzle body, and the nozzle body also being formed to include a second channel having a first opening receiving air, a second opening receiving fuel, an air and fuel combining chamber communicating with the first and second openings, and an exit for discharging a second fuel/air mixture created in the air and fuel combining chamber along a second flow path out from the nozzle body, the second flow path intersecting the first flow path in the combustion chamber to cause impingement of the mixtures carried along the first and second flow paths to create flame stability, the nozzle body also being formed to include a fuel-distribution chamber therein, the fuel-distribution chamber being defined by an inner wall and having a fuel entrance for receiving fuel, a first fuel passage extending between the inner wall and the second inlet, and a second fuel passage extending between the inner wall and the second opening of the nozzle body.

3. The apparatus of claim 2, wherein the nozzle body is formed to include channel means for discharging fuel from the fuel-distribution chamber to the combustion chamber.

4. The apparatus of claim 3, wherein the fuel-distribution chamber is formed to lie between the first and second channels.

5. The apparatus of claim 2, wherein the fuel-distribution chamber is positioned in the nozzle body to lie between the first and second channels.

6. A burner apparatus comprising combustion chamber, and a nozzle body coupled to the combustion chamber, the nozzle body being formed to include a first channel having a first inlet receiving air, a second inlet receiving fuel, an air and fuel mixing chamber communicating with the first and second inlets, and an outlet for discharging a fuel/air mixture created within the air and fuel mixing chamber along a first flow path out from the nozzle body, the nozzle body also being formed to include a second channel having a first opening receiving air, a second opening receiving fuel, an air and fuel combining chamber communicating with the first and second openings, and an exit for discharging a second fuel/air mixture created in the air and fuel combining chamber along a second flow path out from the nozzle body, the second flow path intersects the first flow path in the combustion chamber to cause impingement of the mixtures carried along the first and second flow paths to create flame stability, the nozzle body further including a front face positioned to lie within the combustion chamber and opposite ends, the outlet of the first channel and the exit of the second channel extending through the front face and being positioned to lie between the opposite ends.

7. The apparatus of claim 6, wherein the first and second channels are formed as slots extending through the front face between exterior side walls of the nozzle body.

8. The apparatus of claim 7, wherein the nozzle body is formed to include a fuel-distribution chamber therein and a raw gas hole extending between the fuel-distribution chamber and the front face.

9. The apparatus of claim 7, wherein the fuel-distribution chamber is positioned to lie between the slots.

10. The apparatus Of claim 6, wherein a plurality of first and second channels are positioned to lie in spaced-apart relation to one another through the front face of the nozzle body.

11. The apparatus of claim 10, wherein a plurality of cooling air holes are positioned to lie in spaced-apart relation to one another through the nozzle body, one cooling air hole is positioned to lie between adjacent first channels, and one hole is positioned to lie between adjacent second channels.

12. A burner apparatus comprising a line-burner combustion chamber, an air housing, and a unitary nozzle body made of a metal material coupled between the line-burner combustion chamber and the air housing, the nozzle body being formed to include a front face positioned to lie in the line-burner combustion chamber, a back face positioned to lie in the air housing, a first channel extending between the front and back faces and having a first inlet extending through the back face for receiving air, a second inlet receiving fuel, an air and fuel mixing chamber communicating with the first and second inlets and having a substantially uniform cross-sectional dimension between the second inlet and the front face, and means for discharging a fuel/air mixture created within the air and fuel mixing chamber past the front face and into the line-burner combustion chamber, and the nozzle body also being formed to include a second channel extending between the front and back faces and having a first opening extending through the back face for receiving air, a second opening receiving fuel, an air and fuel combining chamber communicating with the first and second openings and having a substantially uniform cross-sectional dimension between the second opening and the front face, and means for discharging a second fuel/air mixture created in the air and fuel combining chamber along a second flow path out from the front face of the nozzle body so that second flow path intersects the first flow path in the line-burner combustion chamber to cause impingement of the mixtures carried along the first and second flow paths to create flame stability.

13. The apparatus of claim 12, wherein the first discharging means is an outlet formed through the front face, the second discharging means is an exit formed through the front face, and the first and second channels extend through the nozzle body at an angle relative to one other so that the first inlet and first opening are positioned at a first distance relative to one another and the outlet and the exit are positioned at a second distance relative to one another, and the first distance is greater than the second distance.

14. The apparatus of claim 13, wherein the second inlet of the first channel is positioned to lie between the first inlet and the outlet and the second opening is positioned to lie between the first opening and the exit.

15. A burner apparatus comprising a line-burner combustion chamber, an air housing, and a nozzle body coupled between the combustion chamber and the air housing, the nozzle body being formed to include a front face positioned to lie in the combustion chamber, a back face positioned to lie in the air housing, a first channel having a first inlet extending through the back face for receiving air, a second inlet receiving fuel, an air and fuel mixing chamber communicating with the first and second inlets, and first discharging means for discharging a fuel/air mixture created within the air and fuel mixing chamber past the front face and into the combustion chamber, the first discharging means being defined by an outlet formed through the front face, and the nozzle body also being formed to include a second channel having a first opening extending through the back face for receiving air, a second opening receiving fuel, an air and fuel combining chamber communicating with the first and second openings, a fuel-distribution chamber positioned to lie between the first and second channels, the fuel-distribution chamber being in fluid communication with both the second inlet and the second opening, and a plurality of second discharging means for discharging a second fuel/air mixture created in the air and fuel combining chamber along a second flow path out from the front face of the nozzle body so that second flow path intersects the first flow path in the combustion chamber to cause impingement of the mixtures carried along the first and second flow paths to create flame stability, the second discharging means being defined by an exit formed through the front face, and the first and second channels extending through the nozzle body at an angle relative to one other so that the first inlet and first opening are positioned at a first distance relative to one another and the outlet and the exit are positioned at a second distance relative to one another, and the first distance is greater than the second distance.

16. The apparatus of claim 15, wherein the nozzle body is formed to include fuel passageways extending between the fuel-distribution chamber and the second inlet and the second opening.

17. The apparatus of claim 15, wherein the nozzle body is formed to include a raw gas hole extending between the front face and the fuel-distribution chamber.

18. The apparatus of claim 12, wherein the first and second discharging means are positioned to lie in spaced apart relation to one another throughout the front face.

19. A burner apparatus comprising a line-burner combustion chamber, an air housing, and a nozzle body coupled between the combustion chamber and the air housing, the nozzle body being formed to include a front face positioned to lie in the combustion chamber, a back face positioned to lie in the air housing, a first channel having a first inlet extending through the back face for receiving air, a second inlet receiving fuel, an air and fuel mixing chamber communicating with the first and second inlets, and a plurality of first discharging means for discharging a fuel/air mixture created within the air and fuel mixing chambers past the front face and into the combustion chamber, the nozzle body also being formed to include a second channel having a first opening extending through the back face for receiving air, a second opening receiving fuel, an air and fuel combining chamber communicating with the first and second openings, and a plurality of second discharging means for discharging a second fuel/air mixture created in the air and fuel combining chambers along a second flow path out from the front face of the nozzle body so that second flow path intersects the first flow path in the combustion chamber to cause impingement of the mixtures carried along the first and second flow paths to create flame stability, the first and second discharging means are positioned to lie in spaced apart relation to one another throughout the front face and the plurality of first discharging means being positioned in a general linear relationship relative to one another, and the plurality of second discharging means being positioned in a general linear relationship relative to one another.

20. The apparatus of claim 19, wherein the nozzle body includes cooling air mixing holes extending through the nozzle body between the front and back faces and the cooling air mixing holes are positioned to lie in a spaced-apart relation relative to one another between adjacent first discharging means and adjacent second discharging means.

21. A burner apparatus comprising a line-burner combustion chamber, an air housing, and a nozzle body coupled between the combustion chamber and the air housing, the nozzle body being formed to include a front face positioned to lie in the combustion chamber, a back face positioned to lie in the air housing, a first channel having a first inlet extending through the back face for receiving air, a second inlet receiving fuel, an air and fuel mixing chamber communicating with the first and second inlets, and first discharging means for discharging a fuel/air mixture created within the air and fuel mixing chamber past the front face and into the combustion chamber, the first discharging means being defined by a slot extending across the front face, the nozzle body also being formed to include a second channel having a first opening extending through the back face for receiving air, a second opening receiving fuel, an air and fuel combining chamber communicating with the first and second openings, and second discharging means for discharging a second fuel/air mixture created in the air and fuel combining chamber along a second flow path out from the front face of the nozzle body so that second flow path intersects the first flow path in the combustion chamber to cause impingement of the mixtures carried along the first and second flow paths to create flame stability, the first and second discharging means being positioned to lie in spaced apart relation to one another throughout the front face the second discharging means being defined by a second slot extending across the front face in spaced-apart relation relative to the first slot.

22. The apparatus of claim 21, wherein the first and second slots are generally linear in shape.

23. An assembly for burning a mixture including at least a gaseous fuel and process air to produce a flame, the assembly comprising a line burner including a nozzle body formed to include gas conduit means and two rows of air conduit means formed in the nozzle body of the line burner, and means for producing a mixing region therein, means for supplying a gaseous fuel to the mixing region through said gas conduit means provided in the nozzle body, means for introducing process air containing oxygen and inerts into said mixing regions at an angle substantially perpendicular to the gaseous fuel supplied in the mixing regions to mix with the gaseous fuel in the mixing regions to produce mixtures, and means for introducing the mixtures into a combustion chamber so that the mixtures impinge one another to create a flame therein.

24. The assembly of claim 23, wherein the two rows of air conduit means are positioned to lie in spaced-apart relationship relative to one another and coincident with the process air introducing means.

25. An assembly for burning a mixture including at least a gaseous fuel and process air to produce a flame, the assembly comprising a line burner including a nozzle body formed to include a front face, a back face, opposite ends, gas conduit means and air conduit means formed as slots extending through the front face of the nozzle body of the line burner between the opposite ends and means for producing a mixing region therein, means for supplying a gaseous fuel to the mixing region through said gas conduit means provided in the nozzle body, means for introducing process air containing oxygen and inerts into mixing regions to mix with the gaseous fuel in the mixing regions to produce mixtures, and means for introducing the mixtures into a combustion chamber so that the mixtures impinge one another to create a flame therein.

26. A method for producing locally lean combustion in a line burner, the method comprising the steps of feeding air into a nozzle body formed to include a first channel having a first inlet receiving air, a second inlet for receiving fuel, an air and fuel mixing chamber communicating with the first and second inlets, and an outlet, a second channel having a first opening receiving air, a second opening receiving fuel, an air and fuel combining chamber communicating with the first and second openings, and an exit, and a fuel-distribution chamber in fluid communication with both the second inlet and the second opening so that the air flows through the first inlet and the first opening and into the air and fuel mixing chamber and the air and fuel combining chamber respectively, channeling fuel from the fuel-distribution chamber through both the second inlet and the second opening and into the air and fuel mixing chamber and the air and fuel combining chamber respectively to create a pre-mixed fuel/air mixture within the channels, and pushing the pre-mixed fuel/air mixture from the outlet of the first channel into the combustion chamber along a first flow path and the pre-mixed fuel/air mixture from the exit of the second channel into the combustion chamber along a second flow path so that the second flow path intersects the first flow path to cause impingement of the pre-mixed fuel/air mixtures to create flame stability.

27. The method of claim 26, wherein the nozzle body further includes a raw gas hole extending between the fuel-distribution chamber and the combustion chamber and the method further includes the step of propelling fuel from the fuel-distribution chamber through the raw gas hole so that the raw gas intersects the second flow path to cause impingement of the raw gas and the pre-mixed fuel/air mixture in the combustion chamber.

28. The method of claim 27, wherein the nozzle body includes a front face formed for extension of the outlet and the exit therethrough and a central axis extending generally perpendicular to the front face and the raw gas flows generally parallel to the central axis.

29. The method of claim 27, wherein the raw gas propelled from the fuel-distribution chamber intersects the first flow path.

30. The method of claim 26, wherein the nozzle body includes cooling air holes extending therethrough and the method further includes the step of channeling air through the cooling air holes to cool the combustion chamber.

31. A line burner nozzle for mixing air and fuel to produce a combustible lean fuel/air mixture in a combustion chamber of a line burner, the line burner nozzle comprising a nozzle body including a front face, means for partitioning the nozzle body to provide two rows of air and fuel mixing chambers, each row of air and fuel mixing chambers including a plurality of separate air and fuel mixing chambers arranged in series and in spaced-apart relation one to another inside the nozzle body and each extending though the front face and having inlets 112*a*, 114*a* and outlets 112*b*, 114*b*, air-providing means in the nozzle body for providing combustion air to each of the separate air and fuel mixing chambers in the two rows of air and fuel mixing chambers, fuel-delivering means in the nozzle body for delivering fuel into each of the separate air and fuel mixing chambers at a predetermined rate and at an angle generally perpendicular to each of the separate air and fuel mixing chambers in the two rows of air and fuel mixing chambers to mix with combustion air in each of the separate air and fuel mixing chambers formed in the nozzle body to produce a lean fuel/air mixture in each of the separate air and fuel mixing chambers, and means in the nozzle body for discharging the lean fuel/air mixture through the front face from each of the air and fuel mixing chambers and the nozzle body into a combustion chamber so that the lean fuel/air mixture discharged from each of the air and fuel mixing chambers in one of the two rows of air and fuel mixing chambers impinges the lean fuel/air mixture discharged from a companion one of the air and fuel mixing chambers in the other of the two rows of air and fuel mixing chambers to produce the lean fuel/air mixture yielding locally lean combustion and therefore low emissions of oxides of nitrogen and other contaminants.

32. The nozzle of claim 31, wherein the fuel-delivering means is positioned in the nozzle body to lie between the two rows of air and fuel mixing chambers.

33. A line burner nozzle for mixing air and fuel to produce a combustible lean fuel/air mixture in a combustion chamber of a line burner, the line burner nozzle comprising a nozzle body including a front face, means for partitioning the nozzle body to provide two rows of air and fuel mixing chambers formed as slots extending through the front face, each row of air and fuel mixing chambers including a plurality of separate air and fuel mixing chambers arranged in series and in spaced-apart relation one to another inside the nozzle body and each extending though the front face, air-providing means in the nozzle body for providing combustion air to each of the separate air and fuel mixing chambers in the two rows of air and fuel mixing chambers, fuel-delivering means in the nozzle body for delivering fuel at a predetermined rate to each of the separate air and fuel mixing chambers in the two rows of air and fuel mixing chambers to mix with combustion air in each of the separate air and fuel mixing chambers formed in the nozzle body to produce a lean fuel/air mixture in each of the separate air and fuel mixing chambers, and means in the nozzle body for discharging the lean fuel/air mixture through the front face from each of the air and fuel mixing chambers and the nozzle body into a combustion chamber so that the lean fuel/air mixture discharged from each of the air and fuel mixing chambers in one of the two rows of air and fuel mixing chambers impinges the lean fuel/air mixture discharged from a companion one of the air and fuel mixing chambers in the other of the two rows of air and fuel mixing chambers to produce the lean fuel/air mixture yielding locally lean combustion and therefore low emissions of oxides of nitrogen and other contaminants.

34. The apparatus of claim 33, wherein the fuel-delivering means is positioned to lie between the slots.

35. A line burner nozzle for mixing air and fuel to produce a combustible lean fuel/air mixture in a combustion chamber of a line burner, the line burner nozzle comprising a nozzle body including a front face and a back face, the nozzle body being formed to include fuel chamber means for receiving a supply of fuel and air chamber means for receiving a supply of combustion air, means for partitioning the nozzle body to provide a first row of air passageways lying in a first plane and including plurality of separate means for conducting combustion air through the nozzle body from the air chamber means through the front face of the nozzle body and into the combustion chamber at a predetermined velocity and a second row of air passageways lying in a second plane aligned at an acute dihedral angle to the first plane to define a fuel supply region in the nozzle body lying between the first and second rows of air passageways and containing the fuel chamber means, the second row of air passageways including a plurality of separate means for conducting combustion air into the combustion chamber at a predetermined velocity, each of the conducting means in the first row of air passageways being arranged to lie in spaced-apart relation one to another inside the nozzle body and extending through the front face of the nozzle body, each of the conducting means in the second row of air passageways being arranged to lie in spaced-apart relation to one another inside the nozzle body and extending through the front face of the nozzle body, and fuel jet means for delivering fuel from the fuel chamber means formed in the fuel supply region through the nozzle body into the conducting means in the first and second rows of air passageways to mix with combustion air passing at a predetermined velocity from the air chamber means into the combustion chamber to produce an unburned lean fuel/air mixture in the conducting means for discharge into the combustion chamber so that the lean fuel/air mixtures impinge one another to produce a combined lean fuel/air mixture yielding locally lean combustion and therefore low emissions of oxides of nitrogen and other contaminants.

36. The nozzle of claim 35, wherein the conducting means extends through both the front face and the back face.

37. The nozzle of claim 36, wherein the fuel jet means intersects the conducting means between the front and back faces.

38. The nozzle of claim 37, wherein the conducting means has a generally uniform diameter between the intersection of the fuel-jet means and the front face.

39. The nozzle of claim 35, wherein the fuel jet means is positioned in the nozzle body to lie between the conducting means.

40. A burner apparatus comprising a combustion chamber and a nozzle body coupled to the combustion chamber, the nozzle body being formed to include first channel means for discharging a first fuel/air mixture along a first flow path from the nozzle body into the combustion chamber and second channel means for discharging a second fuel/air mixture from the nozzle body into the combustion chamber along a second flow path intersecting the first flow path in the combustion chamber to cause the first and second fuel/air mixtures to intermix in the combustion chamber, the first channel means including a first inlet receiving air, a second inlet receiving fuel, an outlet communicating with the combustion chamber, an air and fuel mixing and delivering channel section receiving fuel through the second inlet and interconnecting the second inlet and the outlet, and a first air-conducting channel section receiving air through the first inlet and communicating air into the air and fuel mixing and delivering channel section at a first angle that is generally perpendicular to the fuel being received from the second inlet to mix with fuel therein to create the first fuel/air mixture, the second channel means including a first opening receiving air, a second opening receiving fuel, an exit communicating with the combustion chamber, an air and fuel combining and delivering channel section receiving fuel through the second opening and interconnecting the second opening and the exit, and a second air-conducting channel section receiving air through the first opening and communicating air into the air and fuel combining and delivering channel section at a second angle that is generally perpendicular to the fuel being received from the second opening to mix with fuel therein to create the second fuel/air mixture, and wherein the air and fuel mixing and delivering channel section associated with the first channel means has a substantially uniform transverse cross-sectional dimension between the second inlet and the outlet and the air and fuel combining and delivering channel section associated with the second channel means has a substantially uniform transverse cross-sectional dimension between the second opening and the exit.

41. The burner apparatus of claim 40, wherein the nozzle body includes a front face positioned to lie in the combustion chamber and formed to include the outlet of the first channel means and the exit of the second channel means and the nozzle body further comprises a first fuel passage for channeling fuel to the second inlet and a second fuel passage for channeling fuel to the second opening and the first and second fuel passages are positioned to lie at an obtuse angle relative to one another.

42. The burner apparatus of claim 41, wherein the front face is a flat surface and the first air-conducting channel section and the second air-conducting channel sections are positioned to lie at an acute dihedral angle to one another.

43. A burner apparatus comprising a combustion chamber and a nozzle body coupled to the combustion chamber, the nozzle body being formed to include first channel means for discharging a first fuel/air mixture along a first flow path from the nozzle body into the combustion chamber and second channel means for discharging a second fuel/air mixture from the nozzle body into the combustion chamber along a second flow path intersecting the first flow path in the combustion chamber to cause the first and second fuel/air mixtures to intermix in the combustion chamber, the first channel means including a first inlet receiving air, a second inlet receiving fuel, an outlet communicating with the combustion chamber, an air and fuel mixing and delivering channel section receiving fuel through the second inlet and interconnecting the second inlet and the outlet, and a first air-conducting channel section receiving air through the first inlet and communicating air into the air and fuel mixing and delivering channel section to mix with fuel therein to create the first fuel/air mixture, the second channel means including a first opening receiving air, a second opening receiving fuel, an exit communicating with the combustion chamber, an air and fuel combining and delivering channel section receiving fuel through the second opening and interconnecting the second opening and the exit, and a second air-conducting channel section receiving air through the first opening and communicating air into the air and fuel combining and delivering channel section to mix with fuel therein to create the second fuel/air mixture, and wherein the air and fuel mixing and delivering channel section associated with the first channel means has a substantially uniform transverse cross-sectional dimension between the second inlet and the outlet and the air and fuel combining and delivering channel section associated with the second channel means has a substantially uniform transverse cross-sectional dimension between the second opening and the exit and the nozzle body includes a front face positioned to lie in the combustion chamber and formed to include the outlet of the first channel means and the exit of the second channel means and the front face is also formed to include a raw gas hole positioned to lie between the outlet of the first channel means and the exit of the second channel means and the nozzle body is formed to include means for discharging fuel through the raw gas hole into the combustion chamber to add fuel to a mixture of the first and second fuel/air mixtures in the combustion chamber.

44. The burner apparatus of claim 43, wherein the front face is also formed to include a plurality of cooling air holes and the nozzle body is formed to include means for discharging air through the cooling air holes into the combustion chamber.

45. A burner apparatus comprising a combustion chamber and a nozzle body coupled to the combustion chamber, the nozzle body being formed to include first channel means for discharging a first fuel/air mixture along a first flow path from the nozzle body into the combustion chamber and second channel means for discharging a second fuel/air mixture from the nozzle body into the combustion chamber along a second flow path intersecting the first flow path in the combustion chamber to cause the first and second fuel/air mixtures to intermix in the combustion chamber, the first channel means including a first inlet receiving air, a second inlet receiving fuel, an outlet communicating with the combustion chamber, an air and fuel mixing and delivering channel section receiving fuel through the second inlet and interconnecting the second inlet and the outlet, and a first air-conducting channel section receiving air through the first inlet and communicating air into the air and fuel mixing and delivering channel section to mix with fuel therein to create the first fuel/air mixture, the second channel means including a first opening receiving air, a second opening receiving fuel, an exit communicating with the combustion chamber, an air and fuel combining and delivering channel section receiving fuel through the second opening and interconnecting the second opening and the exit, and a second air-conducting channel section receiving air through the first opening and communicating air into the air and fuel combining and delivering channel section to mix with fuel therein to create the second fuel/air mixture, and wherein the air and fuel mixing and delivering channel section associated with the first channel means has a substantially uniform transverse cross-sectional dimension between the second inlet and the outlet and the air and fuel combining and delivering channel section associated with the second channel means has a substantially uniform transverse cross-sectional dimension between the second opening and the exit and the nozzle body includes a front face positioned to lie in the combustion chamber and formed to include the outlet of the first channel means and the exit of the second channel means and the front face is also formed to include a plurality of cooling air holes and the nozzle body is formed to include means for discharging air through the cooling air holes into the combustion chamber.

46. The burner apparatus of claim 40, wherein the nozzle body is a unitary member made of a metal material and includes a front face formed to include the outlet of the first channel means and the exit of the second channel means and a back face formed to include the first inlet of the first channel means and the opening of the second channel means and the first and second air-conducting channel sections extending into the nozzle body from the back face.

47. A burner apparatus comprising a combustion chamber and a unitary nozzle body made of a metal material and including a front face that is a flat surface and is coupled to the combustion chamber and a back face facing away from the combustion chamber, the unitary nozzle body being formed to include a first channel having a first inlet receiving air and being formed in the back face, a second inlet receiving fuel, an air and fuel mixing chamber communicating with the first and second inlets, and an outlet formed in the front face for discharging a fuel/air mixture created within the air and fuel mixing chamber along a first flow being formed from the nozzle body into the combustion chamber, and the unitary nozzle body also being formed to include a second channel having a first opening receiving air and being formed in the back face, a second opening receiving fuel, an air and fuel combining chamber communicating with the first and second openings, and an exit formed in the front face for discharging a second fuel/air mixture created in the air and fuel combining chamber along a second flow path out from the nozzle body into the combustion chamber, and wherein the second flow path intersects the first flow path in the combustion chamber to cause impingement of the mixtures carried along the first and second flow paths to create flame stability.

48. A burner apparatus comprising a combustion chamber and a unitary nozzle body made of a metal material and including a front face coupled to the combustion chamber and a back face facing away from the combustion chamber, the unitary nozzle body being formed to include a first channel having a first inlet receiving air and being formed in the back face, a second inlet receiving fuel, an air and fuel mixing chamber communicating with the first and second inlets, and an outlet formed in the front face for discharging a fuel/air mixture created within the air and fuel mixing chamber along a first flow being formed from the nozzle body into the combustion chamber, and the unitary nozzle body also being formed to include a second channel having a first opening receiving air and being formed in the back face, a second opening receiving fuel, an air and fuel combining chamber communicating with the first and second openings, and an exit formed in the front face for discharging a second fuel/air mixture created in the air and fuel combining chamber along a second flow path out from the nozzle body into the combustion chamber, and wherein the second flow path intersects the first flow path in the combustion chamber to cause impingement of the mixtures carried along the first and second flow paths to create flame stability and the front face is also formed to include a raw gas hole positioned to lie between the outlet of the first channel and the exit of the second channel and the nozzle body is formed to include means for discharging fuel through the raw gas hole into the combustion chamber to add fuel to a mixture of the first and second fuel/air mixtures in the combustion chamber.

49. The apparatus of claim 48, wherein the front face is also formed to include a plurality of cooling air holes and the nozzle body is formed to include means for discharging air through the cooling air holes into the combustion chamber.

* * * * *